United States Patent [19]

Reinhall

[11] 4,236,959

[45] * Dec. 2, 1980

[54] METHOD OF PRODUCING FIBER PULP BY GRINDING FIBROUS MATERIAL IN A STEAM ENVIRONMENT

[76] Inventor: Rolf B. Reinhall, Killingevagen 16, Lidingo, Sweden

[ * ] Notice: The portion of the term of this patent subsequent to Nov. 12, 1991, has been disclaimed.

[21] Appl. No.: 935,744

[22] Filed: Aug. 21, 1978

Related U.S. Application Data

[63] Continuation of Ser. No. 739,432, Nov. 8, 1976, abandoned, which is a continuation of Ser. No. 561,250, Mar. 24, 1975, abandoned, which is a continuation of Ser. No. 500,369, Aug. 26, 1974, abandoned, which is a continuation of Ser. No. 316,290, Dec. 18, 1972, abandoned.

[30] Foreign Application Priority Data

Dec. 20, 1971 [SE] Sweden ..... 16359/71

[51] Int. Cl.[2] ..... D21B 1/14

[52] U.S. Cl. ..... 162/23; 162/24; 162/26; 162/61; 241/18; 241/28; 241/245

[58] Field of Search ..... 162/26, 23, 28, 61, 162/24, 252, 254, 17, 19, 71; 241/28, 245, 18, 17, 33, 34, 15

[56] References Cited

U.S. PATENT DOCUMENTS

| | | | |
|---|---|---|---|
| 2,008,892 | 7/1935 | Asplund | 162/23 |
| 2,561,043 | 7/1951 | Ayers | 241/245 |
| 2,717,195 | 9/1955 | Armstrong | 162/26 |
| 3,388,037 | 6/1968 | Asplund | 162/23 |
| 3,661,328 | 5/1972 | Leask | 241/18 |
| 3,725,193 | 4/1973 | Montigny et al. | 162/23 X |
| 3,741,863 | 6/1973 | Brooks | 241/28 |
| 3,765,611 | 10/1973 | Steiniger | 241/18 |
| 3,808,090 | 4/1974 | Logan et al. | 162/23 |
| 3,847,363 | 11/1974 | Reinhall | 241/245 |
| 3,910,505 | 10/1975 | Reinhall | 241/18 |

FOREIGN PATENT DOCUMENTS

| | | | |
|---|---|---|---|
| 720216 | 10/1965 | Canada | 162/23 |

*Primary Examiner*—S. Leon Bashore
*Assistant Examiner*—Steve Alvo
*Attorney, Agent, or Firm*—Eric Y. Munson

[57] ABSTRACT

The invention relates to a method in or relating to grinding of vegetable material in a grinding apparatus equipped with discs mounted rotatably relatively one another in a casing, within which a superatmospheric pressure is maintained by steam. This steam is introduced into the casing together with the vegetable material to be ground through a central inlet into an interspace defined by the discs. The material and the steam pass radially outward through said interspace. Immediately on departure from the interspace the ground pulp is received by an atmosphere of a non-condensable gas, the action of which gives the final product desired properties.

3 Claims, 1 Drawing Figure

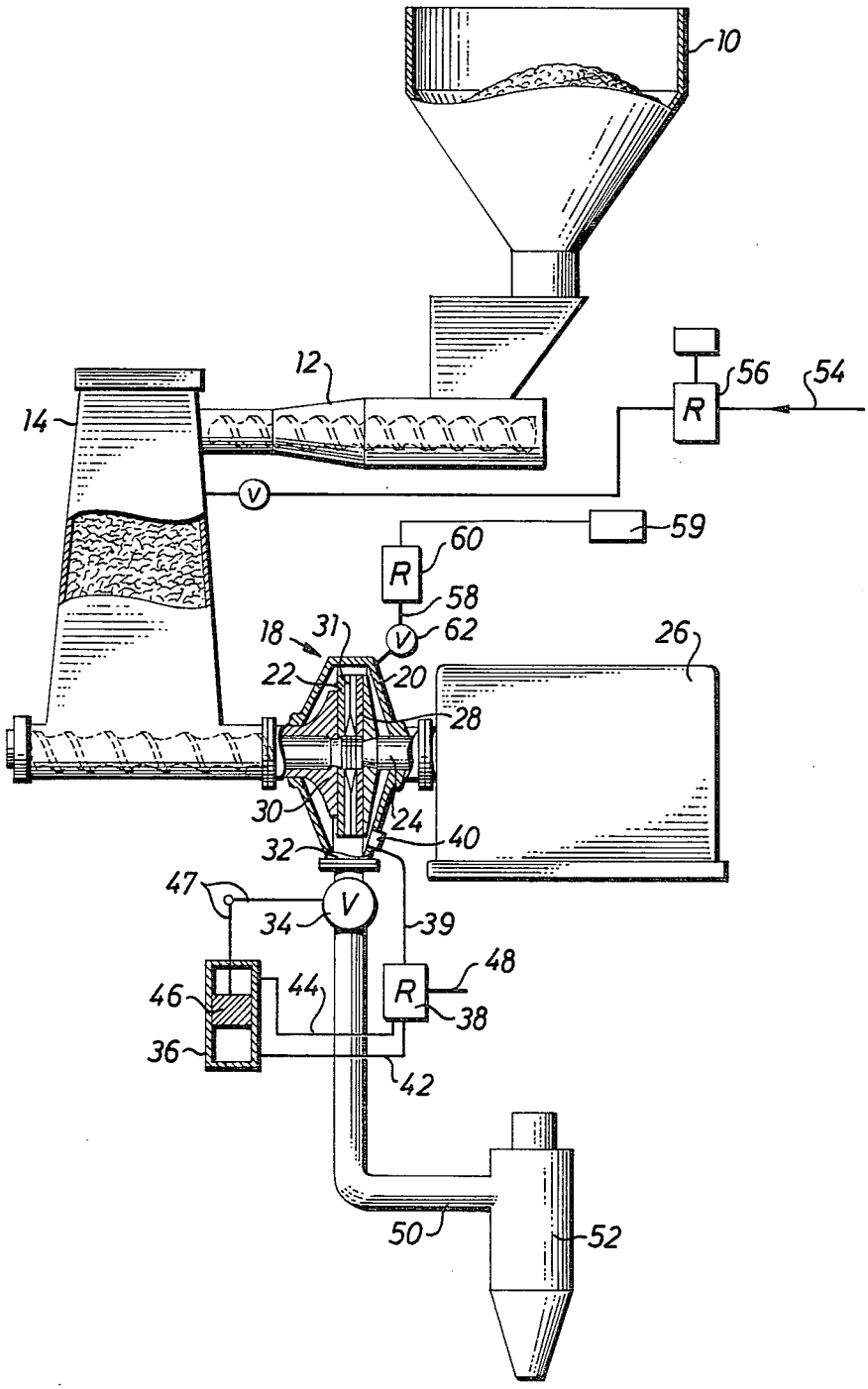
10
12
14
56
54
R
V
59
60
R
58
62
V
18
31
22
20
26
28
30
24
40
32
47
V
34
39
48
46
44
R
38
36
42
50
52

METHOD OF PRODUCING FIBER PULP BY GRINDING FIBROUS MATERIAL IN A STEAM ENVIRONMENT

This is a continuation of application Ser. No. 739,432 filed Nov. 8, 1976, now abandoned, which was a continuation of application Ser. No. 561,250 filed Mar. 24, 1975, now abandoned, which was a continuation of application Ser. No. 500,369 filed Aug. 26, 1974, now abandoned, which was a continuation of application Ser. No. 316,290 filed Dec. 18, 1972 now abandoned.

FIELD OF THE INVENTION

This invention relates to a method in or relating to grinding of vegetable material in grinding apparatus.

BACKGROUND OF THE INVENTION

More particularly, this invention relates to a method in or relating to grinding of vegetable material in grinding apparatus which comprises discs mounted rotatably relative to one another in a casing and having an interspace between them, in which interspace the material to be ground is disintegrated during its passage in radially outward direction together with steam, from a central inlet. A superatmospheric pressure is maintained in said casing by means of the steam which together with the raw material, is introduced into the interspace between the grinding discs. Usually, an adjustable control valve is provided in an outlet from the casing for the ground product.

OBJECTS OF THE INVENTION

One main object of the invention is to improve the properties of the ground product in desired direction by an action which prevents attacks on the fibre surfaces in the moment of their becoming uncovered when they leave the interspace between the grinding discs. Furthermore, this action may have for its purpose to increase the yield and/or to reduce the hydrolysis of the fibrous material.

Another important object of the invention is to combine the grinding operation with a chemical action which bleaches the fibres or increases their capacity to resist the action of light.

PRINCIPAL FEATURES OF THE INVENTION

According to one main feature of the invention the ground pulp immediately after its departure from the interspace into the interior of the casing is received by an atmosphere of a non-condensable gas.

Preferably, the gas has a lower temperature than that of the pulp, so that the pulp is cooled. In addition, the gas may be of such a kind as to inhibit the action on the ground pulp of the steam and/or chemicals admixed to the material. Instead, the gas may exert a chemical effect on the ground pulp. In particular, this effect may consist in a bleaching effect on the exposed pulp fibres.

Examples of gases which may come into consideration for the purpose in view are atmospheric air, nitrogen, carbon dioxide, oxygen, ozone, peroxides, sulphur dioxide and ammonia. The gaseous atmosphere of the casing may include one or a plurality of said gases depending on the action on the fibres which is desired.

According to a preferred embodiment of the invention, the introduced gas serves also to increase the heat economy of the process by reducing the quantity of steam consumed in the grinding operation, without involving any risk of clogging in the interior of the grinding apparatus. In connection therewith, the duration of stay of the material to be ground in the interspace between the grinding discs may be adjusted so as to arrive at a final product possessing a maximum of desirable properties.

The action on the fibrous material, according to the method of the present invention, becomes essentially more favourable due to the fact that the individual fibres are separated from one another so as to have their surfaces freely exposed to the action of the gas rather than when this gas is supplied ahead of the inlet for the not yet ground material into the apparatus.

DETAILED DESCRIPTION OF A PREFERRED APPARATUS FOR CARRYING OUT THE METHOD

Further objects, advantages and features of the invention will become apparent from the following description of a preferred apparatus for carrying out the method of the invention shown diagrammatically and viewed from one side in the accompanying drawing, which forms part of this specification.

Referring now to the drawing, reference numeral 10 denotes a stock vessel for the raw material, such as wood in the disintegrated state of so-called wood chips. The raw material is introduced by a feeding device 12, such as a screw conveyor, into a receptacle 14 subjected to a steam pressure P1, the feeding device tightening against said pressure. The receptacle 14 is mounted with its bottom over a conveyor screw 16 for the wood material in direct communication with a grinding apparatus 18 of the disc type, said apparatus comprising a closed casing 20 within which are mounted a stationary grinding disc 22 and a rotatable grinding disc 28 mounted on a shaft 24 in the frame 26. The raw material supplied by the conveyor screw 16 is fed through a central aperture 30 at the inner periphery of an interspace 31 formed between the two grinding discs 22, 28. Simultaneously steam under the pressure P1 follows, and thus also passes through the interspace 31 together with the material when this is ground between the grinding discs and conveyed radially outwards into the surrounding casing 20. Said casing 20 has at its bottom a discharge or outlet 32 controlled by an exhaust valve 34 capable of adjusting the passage area of the outlet.

The valve 34 is adjusted by means of a mechanism or servo motor 36, e.g. of the cylinder and piston type, and controlled by a control device or regulator 38 which, in turn, via a conduit 39 and a pressure sensing instrument 40, is continually actuated by the steam pressure prevailing in the grinding casing 20. In the illustrated embodiment, the regulator 38 is connected by means of pipe 42, 44 to the one or the other side, respectively, of a piston 46 forming part of the machanism or servo motor 36. The regulator 38 is in connection with through a pipe 48 a source for compressed air and is adapted to supply compressed air through the conduits 42, 44 to the one or the other side, respectively, of the piston 46, so that the piston through articulated system 47 displaces the valve towards a more open or closed position in accordance with the pressure prevailing in the casing 20.

The outlet 32 may be in connection through conduit 50 with a centricleaner 52 for separating the steam accompanying the ground product.

From a pressure source not shown steam is supplied through a pipe 54 into the receptacle 14. Provided in this pipe is a pressure reducing apparatus 56, by which the steam pressure is adjusted to a slightly lower although constant value which thus becomes the steam pressure P1 for the primary steam. This steam streams together with the raw material through the interspace 31 between the grinding members 22 and 28 out into the casing 20, the flow speed of said steam thus varying in correspondence with the discharge of finished product and escape of steam through the valve 34. This discharge in turn affects the duration of stay of the product in the grinding interspace 31 and therewith also the quantity of energy supplied to the product from the grinding apparatus.

According to the invention, the casing 20 of the grinding apparatus is provided with a separate inlet pipe 58 for a non-condensable gas, which by a compressor (not shown), is given the pressure P2. Provided in the pipe 58 is a control instrument or regulator 60 which adjusts the pressure P2 of the non-condensable gas to a value which is lower than the steam pressure P1. The pressure difference, which is adjustable, may amount to several atmospheres in the superatmospheric range.

Also provided in the inlet or pipe 58 may be a valve 62 by means of which, e.g. during the initial adjusting of the grinding apparatus to predetermined operating conditions, the supply of compressed air can be adjusted so as to cause the exhaust of steam through the valve 34, together with finished product to remain at a desired minimum value.

The interspace 31 between the two grinding discs 22, 28 in the grinding apparatus 18 of the disc type, in a manner known per se may be adjusted to a desired magnitude with regard to the properties to be obtained in the ground product. This adjustment can be controlled by a servo motor mechanism of the known type shown and described in the U.S. patent specification No. 2,891,733, for example. The active grinding surfaces of the grinding discs are formed by elongated grooves and projections spaced from one another in a manner known per se.

OPERATION OF THE PREFERRED APPARATUS

The exhaust valve 34 always is given a discharge area such that it cannot be blocked by clogging of finished product under discharge through the interspace 31. Within the grinding casing 20, at the side of discharge from the interspace between the grinding discs, a pressure prevails which is adjusted to a desired maximum value P2. In case ground product is accumulated in the valve 34 so that valve tends to become blocked, the quantity of steam streaming out from the grinding casing 20 is reduced at the same time. The pressure P2, which is defined by the regulator 60, will then be exceeded by steam under the higher pressure P1 continuing to pass, together with fresh grinding material, through the interspace between the grinding discs. The result will be an increase of pressure in the grinding casing, to which increase the regulator 38 reacts so that the mechanism 36 transmits an impulse, causing increase of the discharge opening of the valve 34. The accumulated ground product can now stream out so that the pressure in the grinding casing 20 returns to the value P2. A similar actuation of the valve 34, although in the opposite direction, takes place when its discharge opening sluices out too much product so that the pressure sinks below the value P2.

The pressure difference P1-P2 becomes determinative for the duration of the passage of the product between the grinding members and therewith the degree of the disintegration therof into fibres or fibrilles. On the other hand, product may collect in the grooves of the grinding discs, depending on variations in the dry content, particle size, resin content etc of the raw material, which will result in the quantity of steam being thereby reduced. This may occur also when at a lasting state a constant quantity of material to be ground passes through the grinding interspace. Unless secondary steam were supplied, the result would be that the pressure in the casing 20 would decrease in spite of the unchanged quantity of finally ground product leaving the grinding interspace. As a matter of fact, the discharge area of the exhaust valve is determined by the pressure prevailing in the casing 20, which pressure, due to the reduced quantity of steam does not reach such a value as is required to overcome the accumulation in progress of finally ground product ahead of the valve 34. The consequence would be a stoppage of the whole apparatus. The supply of non-condensable pressure medium according to the invention not only ensures that the pressure in the casing always reaches the high value required to cause the intended discharge through the valve 34, but the pressure medium also exerts a cooling effect on the ground product and causes evaporation of steam respectively, whereby the product is effectively protected against discolouring by hydrolysis. The pressure medium has a lower temperature than the steam introduced into the casing 20. The pressure medium may exert a chemical action on the fibres at the same moment when they leave the interspace between the grinding discs and thus are separated from one another. This chemical action on the exposed surfaces of the fibres may be a bleaching process. If desired, more than two grinding discs may be included in the grinding casing. The grinding discs or members may both be rotatable, either with varying angular velocities or in opposite directions. The pressure medium, such as compressed air, may have room temperature or be preheated, if desired.

While one more or less specific embodiment of the invention has been shown and described, it is to be understood that this is for purpose of illustration only, and that the invention is not to be limited thereby, but its scope is to be determined by the appended claims.

What is claimed is:

1. In the method of producing fiber pulp from moisture-containing fibrous vegetable material wherein the fibrous material is introduced in a steam environment of predetermined superatmospheric pressure and corresponding temperature into a central portion of a grinding interspace defined between a pair of facially opposed grinding discs which rotate relative to one another within a surrounding closed casing to propel the mixture of pressurized steam and ground material radially outwards within the interspace and into the surrounding casing from which the ground material and residual steam is removed under a controlled rate of discharge in response to fluctuations in a predetermined discharge pressure within the casing, the improvement in said method resulting in increased heat economy and improved pulp quality, comprising:

contacting the mixture of steam and ground material upon its emergence from said interspace with a noncondensable gas, other than the steam, of lower pressure than said steam environment to reduce the partial pressure of the steam while maintaining the predetermined total pressure within the casing with consequent expansion of the steam to cause it to become momentarily superheated and unsaturated, thereby exerting a cooling effect on the ground material by evaporation of moisture and thereby minimizing hydrolysis of the pulp material.

2. The improved method as claimed in claim 1, wherein the discharge rate is increased when the monitored pressure becomes higher than the pressure of the non-condensable gas.

3. The improved method as claimed in claim 1, wherein the discharge rate is decreased when the monitored pressure becomes lower than the pressure of the non-condensable gas.

* * * * *